US005524457A

United States Patent [19]

Dunham

[11] Patent Number: 5,524,457

[45] Date of Patent: Jun. 11, 1996

[54] PIERCED EARRING ON WHICH TO HANG A CLIP OR PIERCED EARRING

[76] Inventor: Ann A. Dunham, 2925 Carriage La., 137, Myrtle Beach, S.C. 29577

[21] Appl. No.: 312,236

[22] Filed: Sep. 26, 1994

[51] Int. Cl.[6] ..... A44C 7/00

[52] U.S. Cl. ..... 63/12; 63/14.1

[58] Field of Search ..... 63/12, 13, 14.1, 63/14.3

[56] References Cited

U.S. PATENT DOCUMENTS

| | | | |
|---|---|---|---|
| 263,755 | 9/1882 | Braverman | 63/12 |
| 3,563,056 | 2/1971 | Noel | 63/12 |
| 3,605,438 | 9/1971 | Chalson | 63/12 |
| 3,630,048 | 12/1971 | Masters | 63/12 |
| 4,993,240 | 2/1991 | Pounder | 63/12 |
| 5,123,264 | 6/1992 | Simmons | 63/12 |
| 5,161,390 | 11/1992 | Sam | 63/12 |
| 5,170,643 | 12/1992 | Porcell, Jr. | 63/12 |
| 5,181,397 | 1/1993 | Battista | 63/12 |

FOREIGN PATENT DOCUMENTS

| | | | |
|---|---|---|---|
| 2519523 | 7/1983 | France | 63/12 |

*Primary Examiner*—Michael J. Milano

[57] ABSTRACT

An improved earring having a thin, flat, elliptical shaped base with a mounting at the top and a protrusion at the back of the bottom of the base to prevent an earring clipped on from falling off. The base also has two holes through which pierced earrings may be inserted.

4 Claims, 1 Drawing Sheet

PIERCED EARRING ON WHICH TO HANG A CLIP OR PIERCED EARRING

BACKGROUND—FIELD OF INVENTION

Figure 1:
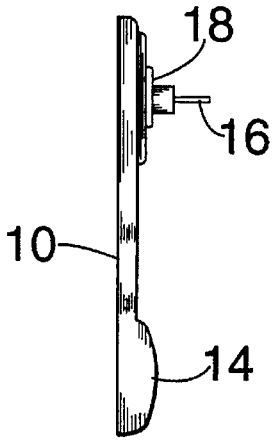

This invention relates to earrings, specifically to unique design features that allow these earrings to do something.

BACKGROUND—DESCRIPTION OF PRIOR ART

To my knowledge, there is no prior art directly relevant to the design features that are completely unique to these earrings.

Pierced and clip earrings have been produced for years but they all suffer from one or more disadvantages:

Pierced Earrings (a) Some posts cause infections to the earlobes.

(b) They may be difficult to insert into and to fasten to the ear, making the process time consuming and frustrating.

(c) To change the desired look, the whole earring has to be removed and replaced.

Clip Earrings (a) Most all clip earrings painfully pinch the earlobes after a time.

(b) If ears are pierced and clip earrings are worn, eventually the holes in the earlobes may close up and repiercing may be required.

(c) Clip earrings may fall off.

(d) To change the desired look, the whole earring has to be removed and replaced.

Both Pierced and Clip Earrings (a) Are designed to be worn one at a time, whereas people now enjoy wearing multiple earrings to the extent some are even having multiple holes made in their ears.

OBJECTS AND ADVANTAGES

Accordingly, several objects and advantages of this invention are:

(a) to provide earrings on which to hang other earrings, even earrings that have posts that could cause infections if inserted into earlobes instead of into the invention. This allows one to wear even the least expensive of pierced earrings, thus expanding one's earring wardrobe.

(b) to provide earrings that allow fast, easy insertion of pierced earrings, for the earrings are being inserted into the invention instead of the earlobes.

(c) to provide earrings where to change the desired look, one only has to change the earrings inserted into the invention, instead of the earrings themselves.

(d) to provide comfortable earrings that prevent clip earrings from pinching the earlobes since the clips are clipped to the invention instead of to the earlobe.

(e) to provide earrings that are pierced, so lobe holes won't have a chance to close, yet allow clip earrings to be worn as often as desired.

(f) to provide earrings that hold clip earrings well, so they don't easily fall off.

(g) to provide earrings where to change the desired look, one only has to change any earrings clipped onto the invention.

(h) to provide earrings designed to hold other earrings, so one or more pierced earring sets may be inserted into and held by the invention, either alone or with one set of clip earrings allowing for tremendous flexibility and creativity in design.

(i) to provide earrings designed to be worn alone, all the time, if desired, so one need never worry about earrings at all if one is in a rush to get dressed in the morning. They will always be in place, attractive enough to stand alone, yet having a standard post and back, they may be removed as desired.

(j) to provide earrings designed to hold various sizes of earrings, and multiple earring back styles.

(k) to provide earrings that may be worn even while telephoning, since when the invention is worn alone, the earrings rest flat against the ears.

Further objects and advantages are to provide earrings that are small, comfortable, light weight, affordable, easy to use and produce, durable, reliable and of high quality.

Additional objects and advantages are to provide earrings that are novel, with no known competition, and that are simple, easy to use, timeless, with broad appeal and a long life cycle.

Still further objects and advantages will become apparent from a consideration of the ensuing description and drawings.

DRAWING FIGURES

Figure 2:
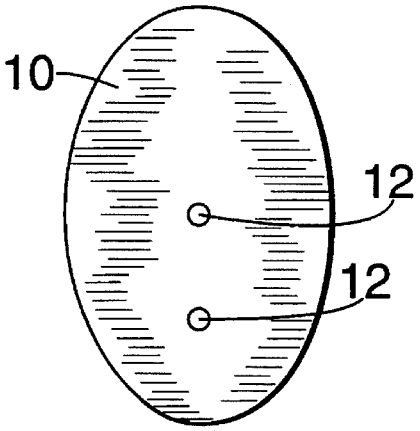
Figure 3:
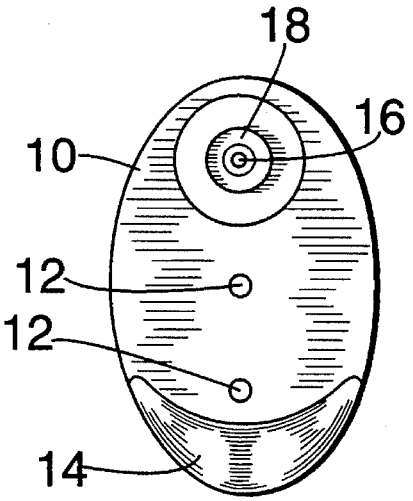
Figure 4:
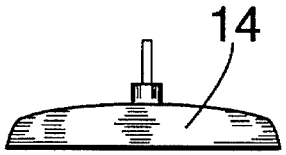
Figure 5:
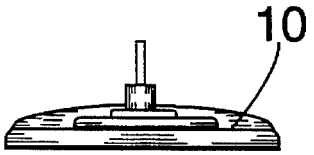

FIG. 1 shows a side elevational view of an earring, the opposite side being identical, FIG. 2 shows a front elevational view of said earring, FIG. 3 shows a rear elevational view of said earring, FIG. 4 shows a bottom view thereof, omitting the post and back, FIG. 5 shows a top view thereof, omitting the post and back.

REFERENCE NUMBERS IN DRAWINGS

10 base of earring
12 hole
14 protrusion
16 post
18 back

DESCRIPTION OF INVENTION

A typical embodiment of the earring of the present invention is illustrated in FIG. 1 (side view) and FIG. 2 (front view).

(A) THE BASE (a) Thickness

In the preferred embodiment, the earring has a thin base 10 typically 1 to 2 mm in thickness except it is thicker at the protrusion at the bottom of the base as hereinafter described. However, the base can be thicker or thinner than the preferred embodiment, or the thickness can vary throughout the base.

(b) Material

In the preferred embodiment, the base's material is gold. However, the base can consist of other materials such as other metals, plastic, wood, fabric, clay, porcelain, etc. or a combination thereof. Plus the material for the base can be flexible instead of rigid and/or transparent, instead of opaque, as in the preferred embodiment of gold material; 10K, 14K, or 18K, etc. Also in the preferred embodiment, the material is solid, though it can be hollow.

(c) Color

In the preferred embodiment, the base material color is the color of yellow gold; however, the color may be white gold, silver, red, blue, green, etc. or it can be multicolored or patterned.

(d) Finish

In the preferred embodiment, the base's entire finish is smooth and highly polished. However, the base's finish can be satin, dimpled, rough, uneven, etc. or a combination thereof.

(e) Shape and Size

In the preferred embodiment, the base's shape is ellipse roughly 18 mm at its widest point and roughly 30 mm in size at its longest point. However, the base can be another shape, such as a circle, square, rectangle, diamond, etc., and can be larger or smaller than the preferred embodiment. In the preferred embodiment, the base's shape is flat on one side and flat on the other (except at the protrusion at the bottom of the base as hereinafter described). However, the base can be convex, concave, etc.

B. FEATURES YIELDING NEW AND UNEXPECTED RESULTS a. Protrusion

In the preferred embodiment, the earring base protrudes at the back at the bottom, so there is a protrusion 14 of the earring that is roughly 2 mm thicker than the rest of the base, so the base is 1 mm thick, the protrusion with the base is roughly 3 mm thick. The protrusion is roughly 5 mm tall at the center of the base and curves up evenly to roughly 8 mm at the sides in relation to the ellipse at its longest point and extends the width of the base at that point. However, the protrusion can be thicker or thinner, taller or wider, and though the preferred embodiment is for a rounded protrusion, the protrusion can be squared off or angled, etc. In the preferred embodiment, the materials, colors, and finishes for the protrusion are the same as for the base, as previously described. However, the protrusion can differ from the base in materials, colors, and finishes. Also, though the preferred embodiment of the protrusion is static, it can be designed to expand or move or to be relocated on the base.

b. Holes

In the preferred embodiment, the base of the earring has two holes 12 in it that are each roughly 1 mm in diameter. They are both centered in the base, width wise. The center of the top hole is roughly 14 mm from the top of the base at its tallest point. The center of the bottom hole is roughly 21 mm from the top of the base at its tallest point. However, the number of holes and their locations in the base of the earring can vary from the preferred embodiment.

In the preferred embodiment, the base has holes and a protrusion. However, the base can have holes or a hole and no protrusion or a protrusion and no holes.

C. MOUNTING

In the preferred embodiment, the earring utilizes a standard post 16 and back 18. In the preferred embodiment, said post 16 is gold, and is roughly ¾ mm in diameter, round, and roughly 10 mm long, and is securely soldered to the rear of the base roughly 6 mm from the uppermost point of the base. However, the post can vary in material, size, location, type, etc.

In the preferred embodiment, the back 18 is gold, is roughly 11 mm in diameter, round, and its center hole of roughly 1 mm begins roughly 6 mm from the top of the base when it's inserted onto the post. However, the back may vary in material, size, configuration, type, etc.

In the preferred embodiment, the mounting is a standard attachment to the earlobe. However, other attachments can be used to attach the base to the earlobe or to attach the base to other things, such as to a necklace.

ADVANTAGES OF INVENTION

From the description above, a number of advantages of my earring become evident:

- One can wear my invention all the time and quickly change the look by attaching to each earring; 1 pierced earring, or 2 pierced earrings, or 1 clip earring, or 1 pierced and 1 clip earring, depending on the sizes and backings of the earrings being affixed to the invention.
- Clip earrings will no longer pinch the earlobe since they are affixed to the invention and not the earlobe.
- Pierced earrings will not infect the earlobe when inserted into the invention instead of into the earlobe.
- It can be easier to insert a pierced earring into the invention than into a hole in an ear.
- Clip earrings can be worn without having to worry about whether or not the holes in ones ears are going to reclose and necessitate repiercing.

OPERATION

The manner of mounting the earring to the earlobe is identical to that for earrings in present use. Namely, one inserts the post 16 into a hole in the earlobe and then into the backing 18.

The revolutionary aspects to the invention are that one can insert another pierced earring post into the invention's top hole and if the post requires a back, secure it to the invention with that earring's back. Then if desired, and if there's room, another pierced earring's post may be inserted into the second hole in the invention, secured with that earring's back, if the post is a type that requires a back. Or one may clip just about any style clip backed earring to the bottom of the invention just by clipping it to the bottom of the invention, and the protrusion 14 will prevent the clip earring from falling off.

To remove the pierced earrings attached to the invention, one simply removes any backs holding them and pulls out the posts from the holes in the invention.

To remove the clip earrings, one simply unclips the earring and the earring releases itself from the invention.

The figures provided show the invention with no earrings affixed.

SUMMARY, RAMIFICATIONS, AND SCOPE

Accordingly, the reader will see that the invention is a simple, elegant earring that differs substantially from earrings commonly worn to date!

This earring's function is to carry or hold other earrings! Yet it is simple to use, and the earrings it carries may be removed, without damage, just as easily as they are affixed.

Furthermore, the earring invented has additional advantages in that:

It is attractive enough to be worn alone, all the time, so one need never wonder what to wear upon awakening and having to rush while dressing, yet it can be removed if desired.

When a change is desired, one simply affixes the desired earring, or earrings, either pierced, clip or both, or, two pierced earrings, to the invention.

It can prevent ear infections since posts of any material can be inserted into the invention, whereas inserted into sensitive lobes, infection could result.

It can prevent clip earrings from pinching the lobe painfully, since the clip earrings are affixed to the invention and not to the lobe.

It greatly expands the earring wardrobe since post and clip quality are secondary, one can purchase and wear more costume jewelry since the invention protects the lobe while it provides an elegant base for other earrings.

It makes it easier to put on pierced earrings, for the earring's post is being inserted into a thin hole in the invention instead of into a thick earlobe.

It can prevent earlobe holes from closing, requiring repiercing, when clip earrings are worn.

It provides more flexibility in which designs can be worn since one can easily wear either clip or pierced earrings, for some earring styles are only made with either clip or pierced backs, not both.

It is designed to lie flat against the ear, so it need not be removed in order to use a telephone.

It is designed to accommodate holding or carrying various sizes and styles of earrings and backs, for maximum flexibility.

Although the description above contains many specifications, these should not be construed as limiting the scope of the invention but as merely providing illustrations of some of the presently preferred embodiments of this invention. For example, the earring base can have other shapes such as circular, trapezoidal, free form, triangular, etc.; the mountings can vary so the base can attach to a necklace, bracelet, etc., instead of to an earlobe; there can be one, three, or more holes in the base rather than two, etc; there can be holes and no protrusion or a protrusion and no holes.

Thus the scope of the invention should be determined by the appended claims and their legal equivalents, rather than by the examples given alone.

I claim:

1. An improved earring for pierced ears comprising a generally flat base having a post extending from the rear surface thereof for insertion through a pierced ear to support said earring, wherein said post extending from the rear surface of said base is permanently secured to said base said base having a rearward protrusion along a bottom edge of said base for supporting a clip earring, wherein said protrusion along said bottom edge of said base comprises a ridge extending along said bottom edge and wherein said ridge is curved, having the lowest portion of the upper edge of said protrusion located between higher ends of said curve.

2. An earring as claimed in claim 1 wherein said protrusion extends about 2 millimeters rearward from the rear surface of said base.

3. An earring as claimed in claim 1 wherein said base has a thickness of between about one millimeter and about 2 millimeters, a height of about 30 millimeters and a width of about 18 millimeters, said base being generally elliptical.

4. An article of jewelry for the ear comprising:

a flat base having a thickness of between about one millimeter and 2 millimeters, a height of about 30 millimeters and a width of about 18 millimeters, said base being generally elliptical and having a top edge, a bottom edge and front and rear faces;

a post permanently secured to said base at a location about 6 millimeters below said top edge of said base and extending from the rear surface of said base, said post having a length of about 10 millimeters;

said base having at least one hole therethrough at a location approximately 8 millimeters below the location of said post; said base having a protrusion extending approximately 2 millimeters rearward from the rear surface of said base along said bottom edge of said base and extending approximately 5 millimeters upward from said bottom edge along the rear surface of said base.

* * * * *